United States Patent [19]

Aloisio

[11] Patent Number: 4,694,768

[45] Date of Patent: Sep. 22, 1987

[54] EMERGENCY AIR SYSTEM FOR PARTIALLY SUBMERGED VESSELS

[76] Inventor: Leonard Aloisio, P.O. Box 276, Patterson, La. 70392

[21] Appl. No.: 812,731

[22] Filed: Dec. 23, 1985

[51] Int. Cl.[4] ..... B63J 2/04

[52] U.S. Cl. ..... 114/71; 114/211; 114/334

[58] Field of Search ..... 114/52, 68, 125, 211, 114/189, 265, 334, 336, 348, 360, 121, 227, 71; 405/203

[56] References Cited

U.S. PATENT DOCUMENTS

| | | | |
|---|---|---|---|
| 1,815,904 | 7/1931 | Grieshaber | 114/336 |
| 2,096,167 | 10/1937 | Farrugia | 114/349 |
| 3,559,610 | 2/1971 | Viollet et al. | 114/125 |

*Primary Examiner*—Sherman D. Basinger

*Attorney, Agent, or Firm*—Pravel, Gambrell, Hewitt, Kimball & Krieger

[57] ABSTRACT

A plurality of tanks situated in the vessel, each of the tanks housing a quantity of air under pressure for use in the system. Each tank connected in series would supply air via a line system to each living quarter in the vessel, perferable at two points along opposite walls of each quarter. There would be further provided an automatic switching mechanism, for example, a pendulum switch, so designed so that when the vessel would tilt beyond a "point of no return", the switch would automatically activate normally closed valves to open and allow air into the lines of the system. In addition, there could be provided a air port within each sleeping quarter to be equipped with a valving mechanism on the entrance port into the quarter so that the valving mechanism could either be automatically or manually activated to allow the pressurized air into that particular quarter. The system of tanks could be so arranged so that a quantity of air could be supplied on an emergency basis over a short period of time, through a first group of tanks, and a second group of tanks could provide a metered amount of air into each of the quarters over a longer period of time. This would, in effect, respectively provide a necessary infusion of air supply following the occurance of the accident. The system would continue to supply fresh air into the air pocket during the rescue operations.

9 Claims, 6 Drawing Figures

EMERGENCY AIR SYSTEM FOR PARTIALLY SUBMERGED VESSELS

BACKGROUND OF THE INVENTION

1. Field of the Invention

The system of the present inventin relates to air systems for vessels. More particularly, the preferred embodiment of the present inventio relates to a system for introducing air into pre-determined areas of a vessel when the vessel has begun to sink or capsize following a catastrophic accident or the like.

2. General Background

In the art of water vessels, more particularly the catagory of larger vessels utilized to transport, because of the nature of the vessel and the work conducted thereon, the vessel must be manned by a crew, and likewise must have quarters to house and feed the crew. A typical type of vessel would be the type utilized for servicing the oil field wherein crew members are housed in the vessel while the vessel is being transported to and from locations or the like. Also, there are certain vessel known as "jack-up rigs", which are actually floatable vessels having a plurality of jacket legs and a crew living on-board the vessel. The vessel is self-transportable out to open sea, at which time the legs are implanted into the water bottom and the vessel "jacks-up" and serves as an isolated structure in the open water.

One of the problems often confronted with any type of sea traffic, is the danger of capsizing. Of course, when a vessel such as the above-typed referenced does in fact become engaged in a water accident while in transit or jacked up on location, these vessels being quite often times loaded with pipe, machinery or other type of heavy material, there is a tendency for the vessel to sink, and or capsize rather rapidly. If, of course, during a simple sinking this equipment should shift, then the vessel would begin to list and may in fact turn over during the act of sinking.

Such an occurrance, would have tragic consequences often times for the crew on board particularly if the accident would have occurred in the middle of the night when most if not all of the crew is asleep in quarters. Of course, the overturning of such a vessel would effectively trap the crew in their crew quarters and would in all likelihood result in some if not all of the crew drowning or suffocating from loss of air from being submerged. It has been found from accidents which have occured in water involving such a vessel, that the crew members bodies who were recovered following the accident, were found times not to have simply or quickly drowned, but to have succomed to asphyxiation before drowning. The theory is that when the vessel overturns, there is trapped air within the quarters, and for a while, sometimes hours, the members in the quarters although the vessel is submerged are able to breath. However, when this pocket of air runs out of the necessary oxygen content, the crew members drown after being quickly asphyxiated. The system of the present invention is designed to provide means for supplying, for a time, the necessary air (approximately 72% N, 28% O) in such an occurance until divers or other rescue efforts can bring the individual who are trapped to safety above the water.

Several patents have issued in the pertinent art, the most important being as follows:

U.S. Pat. No. 3,141,438 issued to Smith entitled "Water Tight and Air Tight Rooms for Ships", relates to water and air tight compartments on ships by providing a ship having all of the outside rooms on all decks incorporating means whereby the room may be made air and water tight in time of emergency such as sinking of the ship.

U.S. Pat. No. 3,453,979 issued to Buck entitled "Fluidic Control System", provides a system to self-contain for lifting an object according to a predetermined velocity and attitude program without the use of external monitors, external system inputs or lifting devices by providing a totally self-contained fluidic control system for buoyant bodies.

U.S. Pat. No. 4,458,618 issued to Tuffier entitled "Safety Device for Rendering A Boat Unsinkable", provides a device for habitable botat having one inflatable planar envelope disposed in a part of the inner volume of the hull of the boat which is devoid of obstacle which might oppose the inflation of the envelope, the normally closed source of gas under pressure connected to the envelope and means for actuating the source of gas for controlling the inflation of the envelope.

U.S. Pat. No. 4,447,474 issued to Ullrich entitled "Catamaran Equipped With Re-Righting Device", relates to a device for providing a catamaran which facilitates the re-righting in difficult situations without physical labor by the provision of forward hulls having floodable forecastles and buoyancy chambers disposed forwardly of the forecastles.

U.S. Pat. No. 3,952,350 issued to Moucha entitled "Gravity Weight Trigger For A Life Raft", relates to an apparatus for providing a life raft inflating device which is gravity actuated such that when the boat is overturn due to bad weather or dangerously steep turns, the device is triggered, inflating the life raft.

SUMMARY OF THE PRESENT INVENTION

The present invention relates to a system for providing a supply of emergency air to specific areas, in particular the living quarters of crew members aboard sea bound vessels. What is provided is a plurality of tanks situated in the vessel, each of the tanks housing a quantity of man-made air vacuum packed under pressure for use in the system. Each tank connected in series would supply air via a line system to the living quarters in the vessel, perferable at two points along opposite walls of each quarter. There would be a further provided an automatic and manual switching mechanism, for example a switch which might be pendulum switches or inclinometer switches, so designed so that when the vessel would tilt beyond a "point of no return", the switch would automatically activate normally closed valves to open and allow air intot he lines of the system. In addition, there could be provided means within each sleeping quarter to be equipped with a valving mechanism such as a back pressure valve, on the entrance port into the quarter so that the valving mechanism could either be automatically or manually activated to allow the pressurized air into that particular quarter. In the preferred embodiment, the system of tanks could be so arranged so that a quantity of air could be supplied on an emergency basis over a short period of time, through a first group of tanks, and a second group of tanks could provide a metered amount of air into each of the quarters over a longer period of time. This would, in effect, respectively provide a necessary infusion of air supply following the occurance the accident. The system would continue to supply fresh air into the air pocket during the rescue operations until total depletion of the tanks, at which time hopefully rescuers will have connected an air input line to the auxiliary line leading to the back side of the cylinder tank system.

Therefore, it is an object of the present invention to provide a system for supplying emergency air supply to certain quarters of a sinking vessel;

It is a further object of the present invention to provide fresh air into an air pocket of a partially or wholly submerged or capsized vessel for allowing continued supply of fresh air to any live persons trapped within those areas;

It is still a further object of the present invention to provide an emergency air supply system having an automatic means for sensing the listing of a vessel to a point where the system would be automatically activated to operate;

It is still a further object of the present invention to provide an automatic air supply system including a means within each quarter to which the system supplies air whereby the air can be allowed into that particular quarter with the use of a back pressure valve.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
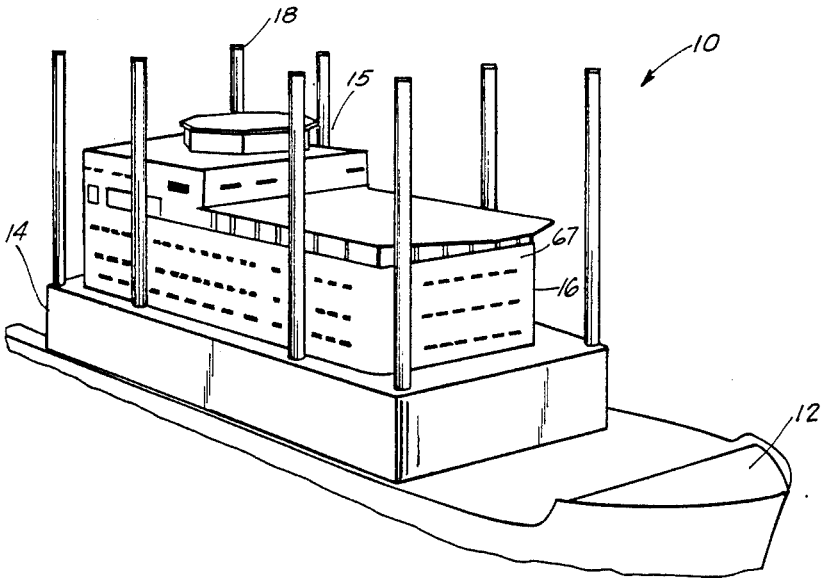
FIG. 1 is an overall perspective view of a "jack-up rig" or other vessel of the preferred embodiment of the system of the present invention.

The system of the preferred embodiment of the present invention is illustrated particularly in FIGS. 2–6. Prior to a discussion of the system, reference is made to FIG. 1, which illustrates a type of vessel that the system would normally be incorporated into. In FIG. 1 there is illustrated a sea going vessel 10 having a bow portion 12, a stern portion, 14, the upper portion 15 of the vessel, including the various sleeping quarters as indicated by numer 16 in FIG. 1. The vessel 10 as illustrated in FIG. 1, for purposes of this application, presents a jack-up rig type of vessel having a plurality of legs 18 which would be lowered into the water for embedding into the undersoil and for jacking up the vessel for use in oilfield procedure. Although the type of vessel is not that important to the overall applicatoin of the invention, for purposes of illustration, this particular type of vessel was selected as seen in FIG. 1.

Figure 2:
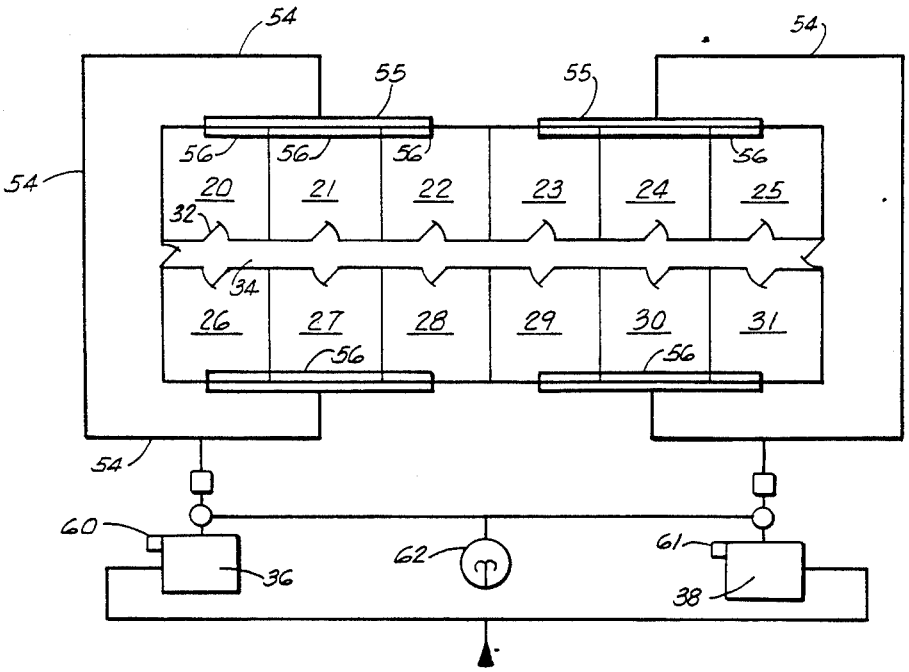
FIG. 2 is a diagram of the preferred embodiment of the of the system of the present invention.

FIG. 2 represents a top view of the vessel taken through a cross-section of the sleeping quarters 16 illustrated in FIG. 1.

In FIG. 2 there is illustrated a plurality of state rooms 20–31. Each of the state rooms, for example state room 20 having an entranceway 32 represented by hinged door for ingress and egress from the room, and in the normal structure perhaps having a window or the like in each of the rooms. The rooms are positioned on either side of a longitudinal hallway 34 running the length of sleeping quarters 16 where any two of the rooms have access thereto.

Figure 3:
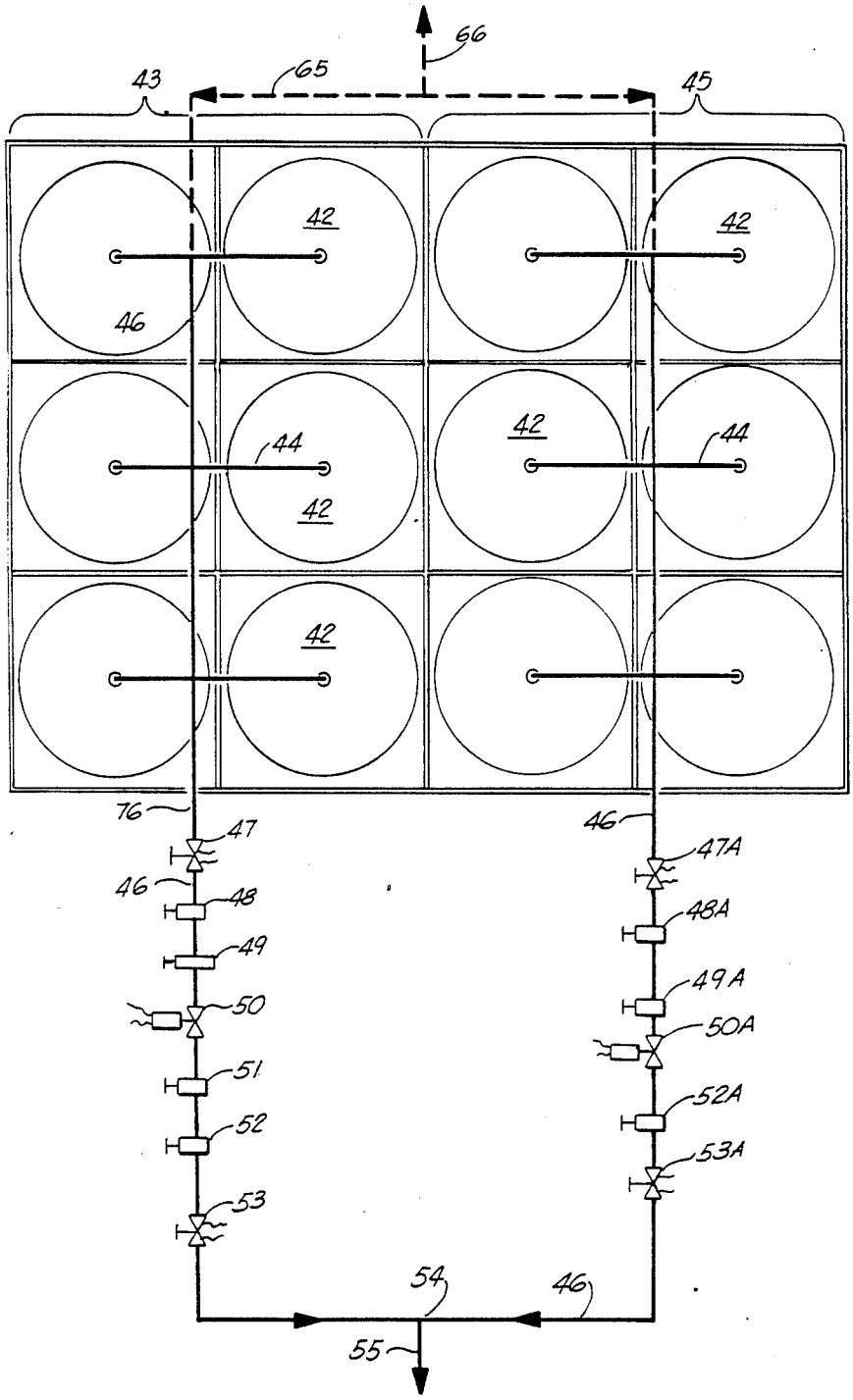
FIG. 3 is a close up view of a supply mechanism of the preferred embodiment of the system of the present invention.

Utilizing this configuration of state rooms and the sleeping quarters 16, the application of the present invention would, as illustrated in FIG. 2, in the perferred embodiment incorporate the components as illustrated in FIGURE 2. One of these comoponents is the system of air tanks 36 and 38 as illustrated in FIG. 3. Prior to discussion of the other components of the system, detailed discussion of the system of air tanks shall be discussed at this time.

Reference is made to FIG. 3 which illustrates in detail a means for suppling pressurized air to the various sleeping quarters, which is a detailed view f the system of tanks 34 and 36 as illustrated in FIG. 2. For purposes of illustration, we will consider that the illustration as seen in FIG. 3 is a representation of air tank system 36, with the understanding that the air tank system 38 is similar in operation. Although only two systems 36 and 38 are illustrated, for a particular size ship or the like vessel there could be a plurality of such systems of air tanks depending on the amount of air needed for the system.

Turning now to FIG. 3, air tank system 36 illustrates a plurality of, i.e., 12 air tanks 42 which are positioned upright and are actually a "cylindric" tanks between 4 to 5 feet in length and able to hold a quantity of compressed air. As seen in the top view in FIG. 3, the system of tanks is actually divided into a first primary bank 43 and a secondary bank 45. Each primary and secondary banks accommodating an arbitrary number of tanks each, the function of each will be discussed further.

Each system of primary and secondary banks 43 and 45 are provided with an air outlet line 44 which would convey compressed air out of each tank 42 into a mainline 46 for use in the system. At this point, turning now to the primary bank 43, mainline 46 would lead first tomanual valve 47, which is always open, unless the system is being tested. Further, there would be positioned in the line a first and second regulator valves 48 and 49 which would be set at a determined air pressure. In order to reduce line pressure on solenoid valve 50 (to minimize gate pressure), there would be provided a second electric valve 50 in the line. This is the master valve, always closed unless in actual use or testing. There would then be provided a valve known as a CRBBM 51, which is a type of relay valve which is normally in the open position, but upon air pressure to the valve or pilot pressure to the valve being interrupted, the valve would then shift closed. The functioning of this valve also will be discussed in the operation of the system. Line 46 would then lead on through valve 51 to a third regulator 52 then on to a third manual valve 53 again used during the testing of the system. Line 46 would then lead to a junction 54 whereby it is then moved to a principal line 55, which is represented both in FIGS. 2 and 3 as leading directly into the various sleeping quarters.

Turning now to secondary bank 45, the secondary bank 45 is identical to primary bank 43 in that there is also an outlet line 44 carrying air to mainline 46. In the secondary bank system of valves, there is again a first manual valve 47(*a*), which is always open unless testing, to allow air into line 46 during operation of the system. There is then further provided again a pair of regulator valves 48(*a*) and 49(*a*), there is provided an electric valve 50(*a*), and an additional regulator valve 52(*a*) and a manual valve 53(*a*) again a test valve for allowing air again from the secondary banks to flow through the system of valves into line 46 to junction 54 and out to the quarters via mainline 55.

Turning now to the functioning of the overall system, reference is nowmade to FIG. 2. As was stated earlier, FIG. 2 is a top representational view of the various sleeping quarters 20–31, each sleeping quarter as seen in the FIGURE has a means for allowing mainline 55 to provide an outlet point 56 in each sleepingquarters so that upon air being introduced into mainline 55 has access to the internal chamber via sleepign quarters 20–31. As seen in FIG. 2, again there is illustrated each compressed air section 36 and 38, having the necessary valve arrangements as illustrated in FIG. 3 so that when activation of the system takes place, air is provided into line 55. As seen further in FIG. 2 for the combination in the system, each section of air tanks 36 and 38 is provided with a seperate battery pack 60 and 61 respectively for providing any electrical energy to the electric valves 50 and 50(*a*) of the primary and secondary banks of each system 36 and 38. Further, as seen in the FIGURE, there is provided a primary switch 62 which is in the perferred embodiment, could be a pendulum switch which when the ship lists to a certain point, and the listing is to a certain degree i.e, the point of no return, the pendulum in the switch is made to contact with the contact points and the switch would in turn activate the system.

What follows is an explanation of how the overall system would operate.

Figure 5:
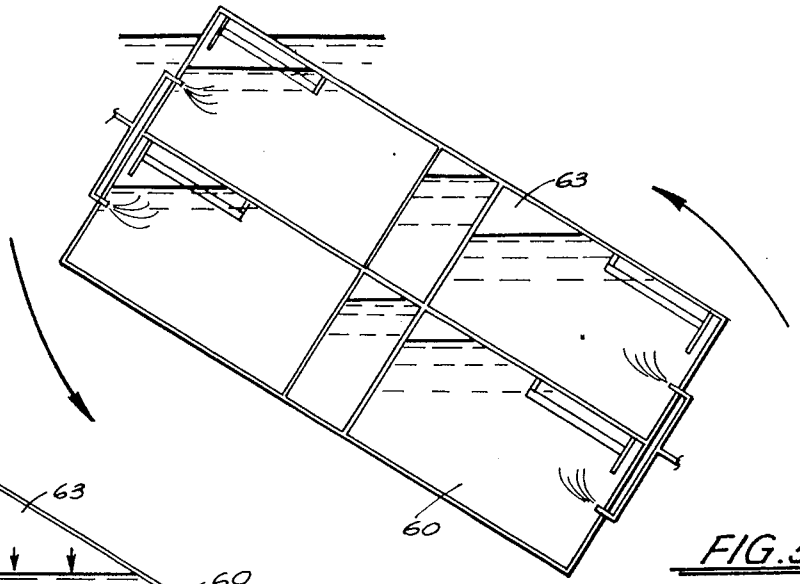
FIGS. 4, 5, and 6 are side representational views of the sleeping quarters of the preferred embodiment of the system of the present invention illustrating the quarters prior to and during submerging or capsizing a vessel.
Figure 6:
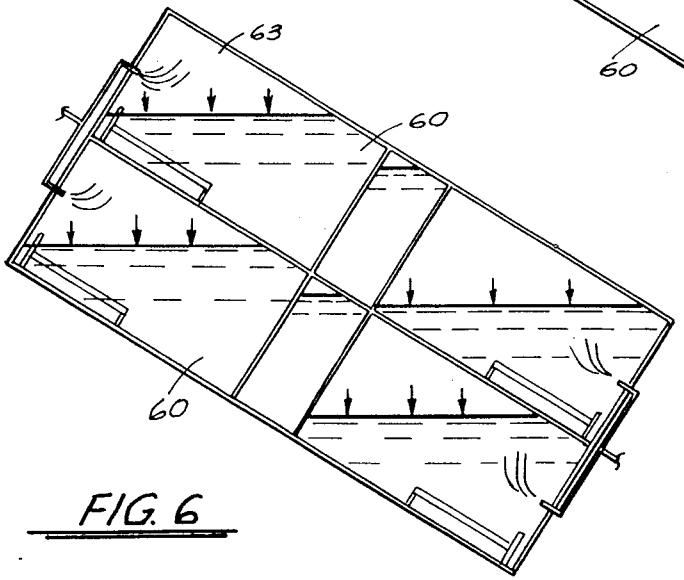
Figure 4:
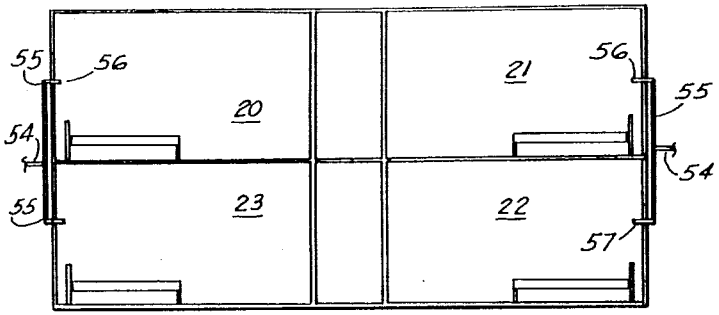

Turning now to FIGS. 4, 5 and 6, these FIGURES represent side views of the sleeping quarters of the vessel 10, with each sleeping quarters having mainline 55 leading into the sleeping quarters wall area with line 55 branching off to each sleeping quarter and air entrance port 56 being available into the wall or ceiling of each sleeping quarter for example, for operation of the system. Of course, as represented in FIG. 4, the system is not in use since the ship is at the normal position i.e., in essence on keel or level in or out of the water. For safety purposes and peace of mind of the crew, while any air ports leading into the various living quarters of the ship would be concealed from view when not in use, and may be for example, positioned hidened behind electrical plates or the like on the wall or ceiling fixtures.

FIGS. 5 and 6, however represent the situation that would occur following a catastrophic accident. For example, the ship 10 is because of either a rupture in the vessel wall or a crash with another vessel or anything, vessel 10 begins to take on water and/or list, to a certain degree, then there is a possibility that the various sleeping quarters in section 16 will begin to take on water 60 as illustrated in FIGS. 5 and 6. Should this occur, automatic or manual switch 62 would activate the system. Pendulum switch 62 will operate valve 50 of the primary bank and shift it into the open position allowing the pressurized air in line 46 to go downhole throught he pressure regulators 48 and 49 and through normally opened CRBBM 50, through manually open valve 53 to junction 54 into main line 55 leading into the various rooms provided by this particular banks of air tanks. In the preferred embodiment, the primary system is particularly adapted to provide a first quantity of compressed air into the rooms as soon as possible to form air pocket 63. This will assure that whomever might be trapped in the room in a particular sleeping quarter, if in fact there was not an air pocket 63 at the time that the accident occurred, that the on rush of this compressed air into the room will then form an air pocket 63 therewithin for available air to breathe for a limited amount of time. The length of time involved in the functioning throughout completion of the primary system, for example system 36, is approximately 5 to 10 minutes for the initial provision of air into the rooms.

Upon the air within the tanks 42 of the primary bank 43 becoming depleted, this zero pressure of the tanks will cause CRBBM valve 50 to shift close, and the valve 50(*a*) of the secondary bank 45 will shift to the open position since it operates off of CRBBM signalling zero pressure in the primary bank, and upon shifting open will allow a metered amount or regulated amount of air through the system of valves into line 55. The secondary bank rather than providing a great quantity of air within a short amount of time will provide a metered amount of air into each room so that the amount of air can be provided over a much longer span of time, in essence, 3 to 6 hours perferrably, so that if there is any problem with the rescue efforts, anyone trapped in the various rooms will be able to be provided with a continuous stream of air into the air pocket. As was stated earlier, although the system is illustrated in FIG. 2 as provided, there could be provided a plurality of air banks 36 and 38 depending on the number of rooms, or the number of tanks per bank increased as needed.

An additional feature of the perferred embodiment might include a means at the entrance port 56 within the various rooms to create equal back pressure, at all entrance ports 56. This assure a more even distribution of air to all quarters. This means would include a back pressure valve 57 in the line which would include a back pressure valve 57 in the line which would allow air contained in line 55 to enter the living quarter 21. Therefore, in utilizing the back pressure valve 57, all rooms would receive the necessary amount of air to form the necessary air pocket for the trapped individuals.

An additional means might be an automatic electrically controlled valve which would automatically open upon activation of a certain switch whether it be the pendulum switch or any other switch in the system for automatically assuring that air would be entering designated rooms, whether or not water was entering or not. This would assure that all rooms, whether having water or not trapped therein, would have available air for breathing by the inhabitants.

As seen in FIG. 6, there is a possibility, although this may be theoretical, that in addition to the air pressure in the system providing air to the person in the air pocket, that the air rushing into the room, particularly from the primary system 43, may, in effect, move a quantity of the water out of the room and provide a greater air pocket for the people trapped in the room. This may be an additional benefit of the invention in that a greater amount of air could be brought into the room and less water than was originally therewithin.

Also as seen in FIG. 3 there is provided a line system 65, which would lead to a mainline 66 for having an air access plug on the exterior of the living quarters of the ship. This would be necessary so that if a diver came down to the sunken ship he could plug an airline into the plug 67, and air would be provided through mainline 66 to line 65 into the line 46 for feeding air directly into the various state rooms. Therefore, this would allow that should the system deplete itself, and divers would still be unavailable to reach the trapped workers, a direct feed through the system from an outside line could be accommodated, and provide a continuous source of fresh air to the various quarters.

It is impratively in maintaining the integrity of the system that the system have the ability to be properly tested during non-use. This is accomplished by the following procedure. Turning now to the primary bank 43, for testing of the system, manual valve 47 would be in the open position, and regulators 48 and 49 would be set at, for example, 200 pounds per square inch pressure. Next, electric valve 50 would be closed, and CRBBM valve 51 would be placed in the open position, i.e., pinned opened to allow air flow therethrough. The final regulator 52 and the primary bank would also be set at the proper pounds per square inch, and manual valve 53 would be placed in the closed position. Upon allowing an impulse to shift electric valve 50 open, air pressure would flow through line 46 but would end at manual valve 53. Therefore, the system would be in working order but of course the air would be stopped at valve 53 so that air would not be wastefully lost.

Likewise, the testing of the secondary bank 45, again manual valve 47(*a*) is in the open position, regulators 48 and 49(*a*) are set on a low air flow for controlling the flow of the secondary system, electric valve 50(*a*) is in the closed position and likewise regulator 52(*a*) is open as is 48(*a*) and 49(*a*), and manual valve 53(*a*) is closed. On impulse, which would normally be an impulse from the CRBBM having shut closed due to complete loss of air in the primary system, electric valve 50(*a*) would shift to the open position with manual valve 53(*a*) being closed stopping the flow of air through the secondary system and therefore, the test is complete.

Because many varying and different embodiments may be made within the scope of the invention concept herein taught, and because many modifications may be made in the embodiments herein detailed in accordance with the desriptive requirement of the law, it is to be understood that the details herein are to be interpreted as illustrative and not in a limiting sense.

What is claimed as invention is:

1. A system for providing pressurized air to quarters within a ship in the event the ship capsizes or sinks, the system comprising:

a. a first quantity of breathable air contained under pressure on board ship;

b. a line extending between the first quantity of pressurized breathable air from a plurality of pressure tanks to the various rooms contained within the ship for supplying the breathable air thereinto upon a given impulse, a first portion of the tanks providing a high flow of air into the various rooms, and the second portion of tanks providing a metering of the pressurized air over a longer length of time;

c. sensing means, provided in the system, for sensing the position of the ship in the water, and upon the ship reaching a certain degree of listing, signaling the release of pressurized breathable air in the system;

d. valving means contained in the line for regulating the quantity of air being transported between the pressurized breathable air and the individuals rooms; and e. means for allowing the high flow of air to be first transported to the various rooms and following the use of this quantity of air, subsequently allowing the metered breathable air to begin flowing to be transported into the various rooms.

2. The system in claim 1, wherein themeans for allowing or disallowing transport of air into the rooms may further comprise a back pressure valve so that the necessary back pressure in each room would be assured, to allow air into all rooms.

3. A system for providing breathable air into quarters in a vessel when the vessel lists pasts a certain degree "point of no return", the system comprising:

a. a plurality of tanks holding a quantity of pressurized breathable air;

b. a transport line for transporting the pressurized breathable air from the tanks t the various quarters within the ship, upon a given signal;

c. signal means in the system for allowing the transport of the pressurized air from the tanks to the various quarters upon the roll of the ship to a particular degree;

d. valving means contained within the system for releasing a first portion of the pressurized breathable air into the various quarters upon receipt of the given signal, and for subsequently releasing a second portion of the pressurized air into the various quarters following the depletion of the pressurized breathable air in the first portion.

4. A system in claim 3, further comprising means contained within each quarter room, for allowing or disallowing the flow of pressurized breathable air from the transport line into the room.

5. The system in claims 3, wherein the first portion of pressurized breathable air releases a high flow of air flowing into the various quarter rooms, and the second portion of pressurized breathable air contains a metered amount of pressurized air flowing into the rooms for transporting air under pressure over a greater amount of time.

6. The system in claim 3, further comprising a manual switch to activate the system in the event the circumstances automatically dictate such action.

7. The system in claim 3, wherein the air contained within the air tanks is pure man made air, comprising only oxygen and nitrogen.

8. The system in claim 3, further comprising means located exterior to the living quarters for allowing a diver to plug into the system, for feeding air from a second vessel into the various living quarters, following the depletion of air in the system.

9. The system in claim 3, wherein the system would be activated when the vessel listed to a degree which would be considered the point of "no return".

* * * * *